US006946821B2

(12) United States Patent
Hamon et al.

(10) Patent No.: US 6,946,821 B2
(45) Date of Patent: Sep. 20, 2005

(54) VOLTAGE REGULATOR WITH ENHANCED STABILITY

(75) Inventors: Cécile Hamon, Grenoble (FR); Christophe Bernard, Claix (FR); Alexandre Pons, Fontaine (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 10/250,410

(22) PCT Filed: Dec. 28, 2001

(86) PCT No.: PCT/FR01/04222

§ 371 (c)(1),
(2), (4) Date: Jun. 30, 2003

(87) PCT Pub. No.: WO02/054167

PCT Pub. Date: Jul. 11, 2002

(65) Prior Publication Data

US 2004/0051508 A1 Mar. 18, 2004

(30) Foreign Application Priority Data

Dec. 29, 2000 (FR) ..... 00 17296

(51) Int. Cl.[7] ..... G05F 1/565
(52) U.S. Cl. ..... 323/273
(58) Field of Search ..... 323/273, 280, 323/281

(56) References Cited

U.S. PATENT DOCUMENTS

| | | | | | |
|---|---|---|---|---|---|
| 5,373,225 | A | | 12/1994 | Poletto et al. | 323/282 |
| 5,563,501 | A | * | 10/1996 | Chan | 323/282 |
| 5,686,821 | A | * | 11/1997 | Brokaw | 323/273 |
| 5,867,015 | A | | 2/1999 | Corsi et al. | 323/316 |
| 6,188,211 | B1 | | 2/2001 | Rincon-Mora et al. | 323/280 |
| 6,246,221 | B1 | * | 6/2001 | Xi | 323/280 |
| 6,420,857 | B2 | * | 7/2002 | Fukui | 323/280 |
| 6,710,583 | B2 | * | 3/2004 | Stanescu et al. | 323/280 |

* cited by examiner

*Primary Examiner*—Adolf Berhane
(74) *Attorney, Agent, or Firm*—Lisa K. Jorgenson; Harold H. Bennett, II; Seed IP Law Group PLLC

(57) ABSTRACT

A voltage regulator having an output terminal adapted to being connected to a load, including an operational amplifier having its non-inverting input connected to a reference voltage, and its inverting input connected to the output terminal, an inverting amplifier having its input connected to the output of the operational amplifier, a capacitive impedance connected between the input and the output of the inverting amplifier, a power switch controlled by the output of the inverter amplifier, arranged to connect the output terminal to a first supply voltage, said capacitive impedance including a short-circuitable portion associated with active short-circuit means when the current flowing through the load is greater than a predetermined current.

18 Claims, 3 Drawing Sheets

VOLTAGE REGULATOR WITH ENHANCED STABILITY

BACKGROUND OF THE INVENTION

1. Technical Field of the Invention

The present invention relates to the field of voltage regulators and in particular to regulators with a low drop-out.

2. Description of the Related Art

A low drop-out regulator made in an integrated circuit may be used to provide a predetermined voltage with low noise to a set of electronic circuits from a supply voltage provided by a rechargeable battery. Such a supply voltage decreases in time and is likely to include noise due for example to the action of neighboring electromagnetic radiations on the battery-to-regulator connections. The regulator is said to have a low drop-out since it enables providing a voltage close to the supply voltage.

FIG. 1 schematically shows a conventional low drop-out regulator. The regulator includes an output terminal 2 intended for being connected to a load R. Load R, essentially resistive, represents the input impedance of the set of the circuits supplied by the regulator. For simplicity, it is considered hereafter that load R is a resistor. The regulator includes an operational amplifier 4 having a non-inverting input $E^+$ connected to a positive reference voltage Vref and having an inverting input $E^-$ connected to output terminal 2 by a feedback loop. Voltage Vref is generated in a known manner by a constant voltage source (not shown) with a high output impedance. Operational amplifier 4 is supplied between a positive supply voltage Vbat provided by the battery and a ground voltage GND. An inverting amplifier 6 supplied between voltages Vbat and GND has an input terminal connected to the output of operational amplifier 4. A capacitor C1 and a resistor R1 are connected in series between the input terminal and the output terminal of amplifier 6. A P-channel MOS power transistor T1 has its drain connected to output terminal 2 and its source connected to voltage Vbat. The gate of transistor T1 is connected to the output terminal of inverting amplifier 6. Transistor T1 is of MOS type, especially to minimize, with respect to the use of a bipolar transistor, the difference between output voltage Vout of terminal 2 and supply voltage Vbat. A charge capacitor C is arranged between output terminal 2 and voltage GND.

The regulator maintains the voltage of output terminal 2 to a value equal to reference voltage Vref. Any variation in voltage Vbat translates as a variation in voltage Vout, which is transmitted by the feedback loop on input $E^-$. When the regulator operates properly, the variation in the voltage of terminal $E^-$ causes the return of voltage Vout to voltage Vref. For this purpose, the regulator circuit, which forms a looped system between input $E^-$ and terminal 2, must form a stable system. The stability of a system is evaluated by considering the gain and the phase shift introduced by the system between its input and its output when the system is in open loop. For this system to be stable when looped, the gain must not exceed 1 when the phase shift is smaller than −180° (phase opposition between the system input and output).

FIG. 2 illustrates, according to frequency f, the variation of gain G and of phase shift $\phi$ of the open-loop regulator between input $E^-$ and terminal 2. For low frequencies f, gain G is equal to static gain G0 of the open-loop regulator. The elements forming the regulator each have a gain which varies according to the frequency. The cut-off frequency of an element having a gain that decreases when the frequency increases corresponds to a "pole" of the transfer function of the open-loop regulator. The cut-off frequency of an element having a gain that increases when the frequency increases corresponds to a "zero" of the transfer function of the open-loop generator. Each pole and each zero of the transfer function of the open-loop regulator respectively introduces a drop and an increase of 20 dB per decade in gain G. Further, each pole and each zero of the transfer function of the open-loop regulator respectively introduces a 90° drop and increase in phase shift $\phi$. For simplicity, it is considered hereafter that the transfer function of the open-loop regulator only includes one main pole P0, two secondary poles P1 and P2, and one zero Z1. The value of main pole P0 especially depends on the inverse of the product of the values of load resistance R and of capacitance C. The value of secondary pole P1 especially depends on the gate impedance of amplifier 6. The value of secondary pole P2 especially depends on the gate capacitance of transistor T1. The values of poles P1 and P2 also depend on the gain of amplifier 6 and on the value of capacitance C1. Inverter amplifier 6 assembled in parallel with a capacitive impedance forms a stage known as a "Miller stage". Such a stage results in decreasing the value of secondary pole P1 and increasing the value of secondary pole P2. The distance between poles P1 and P2 increases with the gain of amplifier 6 and the capacitance of capacitor C1. The value of zero Z1 especially depends on the existing ratio between the values of resistance R1 and of capacitance C1. The choice of the gain of amplifier 6, of capacitor C1, and of resistor R1 enables adjusting the positions of poles P1 and P2 and of zero Z1 so that, when phase shift $\phi$ becomes equal to −180°, gain G is smaller than the unity gain (0 dB). In FIG. 2, pole P0 is at a low frequency, pole P1 is at a greater frequency than pole P0, and pole P2 is at a frequency greater than pole P1. Zero Z1, close to pole P1, is located between poles P1 and P2. For a frequency smaller than the frequency of pole P0, the gain is equal to static gain G0 of the open-loop regulator. Between poles P0 and P1, the gain drops by 20 decibels per decade. Between pole P1 and zero Z1, the gain drops by 40 decibels per decade. Between zero Z1 and pole P2. the gain drops by 20 decibels per decade, and beyond pole P2, the gain drops by 40 decibels per decade. The phase shift drops from 0 to −90° at pole P0. The phase shift decreases under −90°, then returns to −90° at pole P1 and zero Z1. The phase shift drops from −90° to −180° at pole P2.

A disadvantage of such a regulator is that the value of load resistance R, which represents the input impedances of integrated circuits, decreases when the output current flowing through load R increases. This decrease in resistance R translates as a shift of main pole P0 towards high frequencies and in a shift to the right of the gain curve, as illustrated in dotted lines by curve G'. This may result in a gain G' with a value greater than 1 (0 dB) when phase-shift $\phi'$ reaches value −180°. A stable conventional regulator for a low output current may also be unstable for a strong output current. It is difficult to form a stable regulator over the entire output current range.

BRIEF SUMMARY OF THE INVENTION

An object of the present invention is to provide a voltage regulator that remains stable over the entire output current range.

To achieve this object, the present invention provides a voltage regulator having an output terminal adapted to being connected to a load, the impedance of which decreases when the current flowing therethrough increases, including an operational amplifier having its non-inverting input connected to a reference voltage, and its inverting input connected to the output terminal, an inverting amplifier having its input connected to the output of the operational amplifier, a capacitive impedance connected between the input and the output of the inverting amplifier, a power switch controlled by the output of the inverter amplifier, arranged to connect the output terminal to a first supply voltage, and a charge capacitor arranged between the output terminal and a second supply voltage, said capacitive impedance including a short-circuitable portion associated with active short-circuit means when the current flowing through the load is greater than a predetermined current.

According to an embodiment of the present invention, the capacitive impedance includes a first capacitor connected in series with a resistor and a second short-circuitable capacitor.

According to an embodiment of the present invention, the capacitance of the second capacitor is smaller than the capacitance of the first capacitor.

According to an embodiment of the present invention, the short-circuit means include a first P-channel MOS transistor having its drain and its source connected across the short-circuitable impedance portion, a control resistor arranged between the first supply voltage and the gate of the first transistor, a controllable current source arranged between the gate of the first transistor and the second supply voltage, and a means for controlling the current source to provide the current source with a control signal depending on the current flowing through the load.

According to an embodiment of the present invention, the current source includes second and third N-channel MOS transistors having their sources connected to the second supply voltage and the gates of which are interconnected, the drain of the second transistor being connected to the gate of the first transistor, the drain and the gate of the third transistor being interconnected.

According to an embodiment of the present invention, the means for controlling the current source includes a fourth P-channel MOS transistor, having its drain connected to the drain of the third transistor and having its source connected to the first supply voltage, the gate of the fourth transistor being connected to the gate of the power switch.

According to an embodiment of the present invention, the inverter amplifier includes a fifth N-channel MOS transistor having its source connected to the second supply voltage, and having its gate and drain respectively connected to the input and to the output of the inverter amplifier, and a sixth diode-connected P-channel MOS transistor having its drain and its source respectively connected to the drain of the fifth transistor and to the first supply voltage.

BRIEF DESCRIPTION OF THE SEVERAL VIEWS OF THE DRAWINGS

The foregoing objects, features and advantages of the present invention will be discussed in detail in the following non-limiting description of specific embodiments in connection with the accompanying drawings, in which.

DETAILED DESCRIPTION OF THE INVENTION

Same references represent same elements in the different drawings. For clarity, only those elements that are necessary to the understanding of the present invention have been shown in the different drawings.

Figure 1:
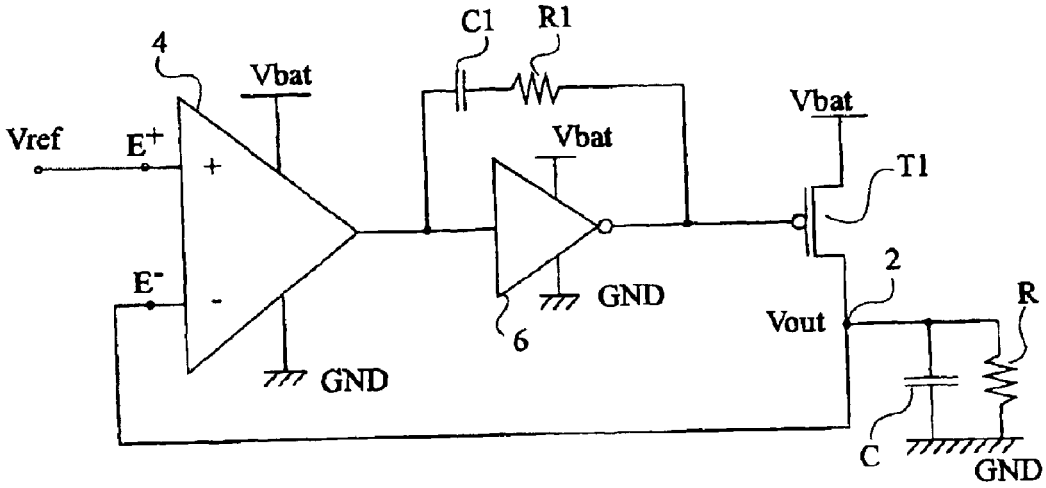
FIG. 1, previously described, schematically shows a conventional voltage regulator.
Figure 3:
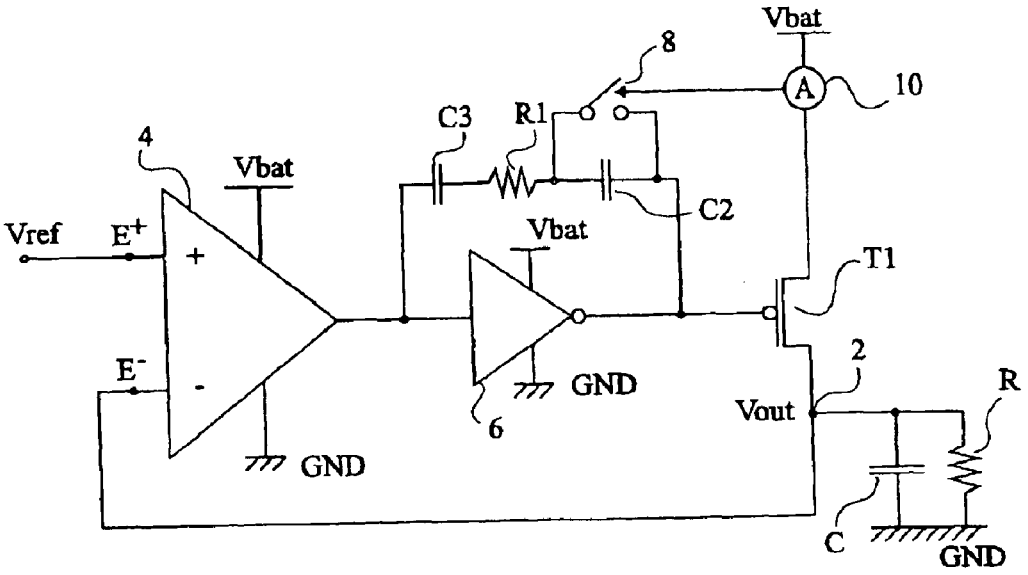
FIG. 3 schematically shows a voltage regulator according to the present invention.

FIG. 3 schematically shows a voltage regulator according to the present invention. The regulator includes an output terminal 2 adapted to being connected to a load R, an operational amplifier 4 having its non-inverting input $E^+$ connected to a voltage Vref and its inverting input $E^-$ connected to terminal 2. An inverter amplifier 6 has its input terminal connected to the output of operational amplifier 4 and its output terminal connected to the gate of a transistor T1 provided for connecting terminal 2 to voltage Vbat. According to the present invention, capacitor C1 of FIG. 1 is replaced with a capacitor C2 is series with a capacitor C3. A switch 8 is arranged to short-circuit capacitor C2. A control means 10 is provided for measuring the current flowing through transistor T1 and for turning on switch 8 when the current running through transistor T1 exceeds a predetermined threshold.

The output current flowing through load R is equal to the current flowing through transistor T1. When switch 8 is off, the capacitance of the impedance connected across amplifier 6 is equal to C2C3/(C2+C3). When switch 8 is on, capacitor C2 is short-circuited and the capacitance of the impedance connected across amplifier 6 is equal to C3. Thus, when switch 8 is turned on, the capacitance increases from C2C3/(C2+C3) to a higher value C3. C2 and C3 will preferably be chosen for C2C3/(C2+C3) to be substantially equal to capacitance C1 of FIG. 1.

As an example, capacitor C3 may have a capacitance of 800 fF and capacitor C2 may have a capacitance of 50 fF.

Figure 2:
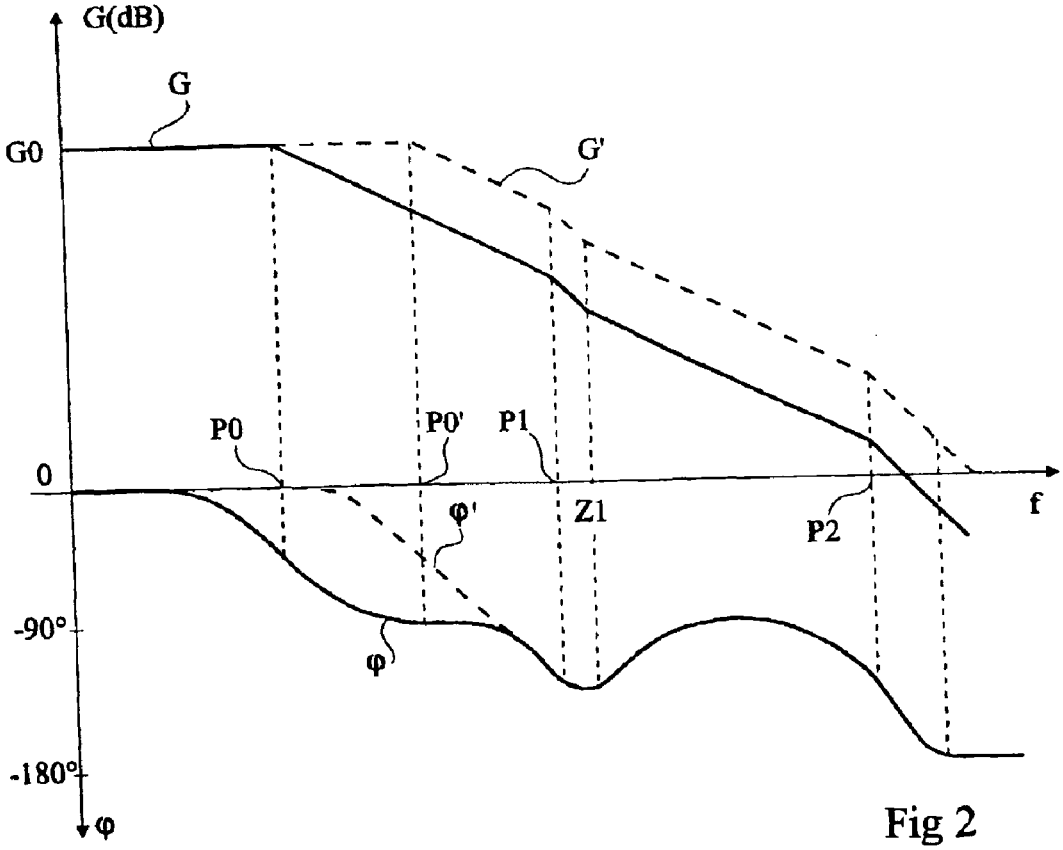
FIG. 2, previously described, illustrates the variations according to frequency of the gain and phase shift of the regulator of FIG. 1 in open loop.
Figure 4:
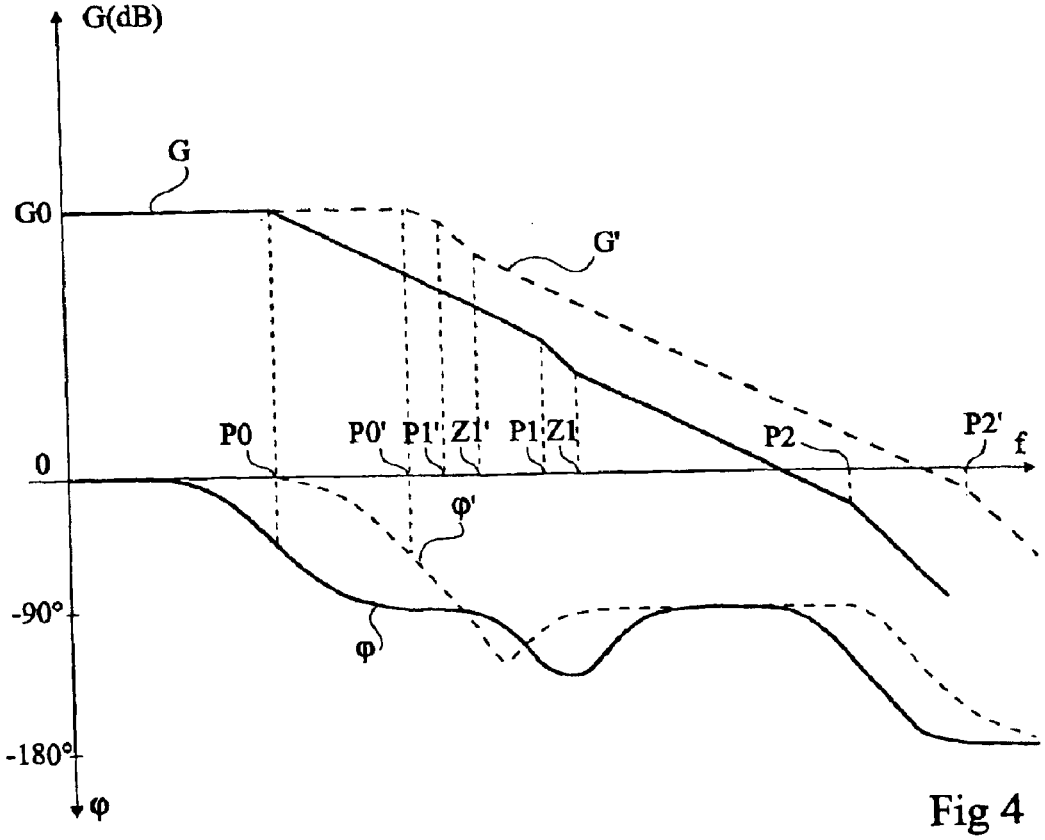
FIG. 4 schematically illustrates the variations according to frequency of the gain and phase shift of the regulator of FIG. 3 in open loop.

FIG. 4 illustrates the variations, according to frequency f, of gain G and phase shift $\phi$ of the open-loop regulator, taken between terminals $E^-$ and 2, in a case where the output current is smaller than the predetermined current. The current flowing through the load is small, the load resistor has a high value R and the primary pole is at a low frequency P0. The capacitance of the impedance connected across amplifier 6 is low, substantially equal to C2. The capacitances of capacitors C and C2, resistance R1, and the gain of amplifier 6 are chosen so that the regulator is stable. The main pole, the two secondary poles, and the zero respectively have values P0, P1, P2, and Z1. For simplicity, these poles have been shown with values substantially identical to their values in FIG. 2.

FIG. 4 also illustrates gain G' and phase shift $\phi'$ of the open-loop regulator, taken between terminals $E^-$ and 2, in a case where the output current is greater than the preceding predetermined current. The current running through load R is strong, load resistor R has a low value and the primary pole has value P0' greater than previous value P0. The capacitance of the impedance connected across amplifier 6 increases to become equal to C3. As seen in relation with FIG. 2, a high value of the capacitance of the impedance arranged across amplifier 6 results in drawing away secondary poles P1 and P2. The first secondary pole has a value P1' smaller than previous value P1 and the second secondary pole has a value P2' greater than previous value P2. The zero has a value Z1' depending on value P1', smaller than previous value Z1. The capacitances of capacitors C, C3, and C2, resistance R1, the gain of inverter amplifier 6, and the predetermined current from which C2 is short-circuited are chosen so that the regulator is stable in the two shown cases. A regulator according to the present invention thus is stable for a low or high output current.

Figure 5:
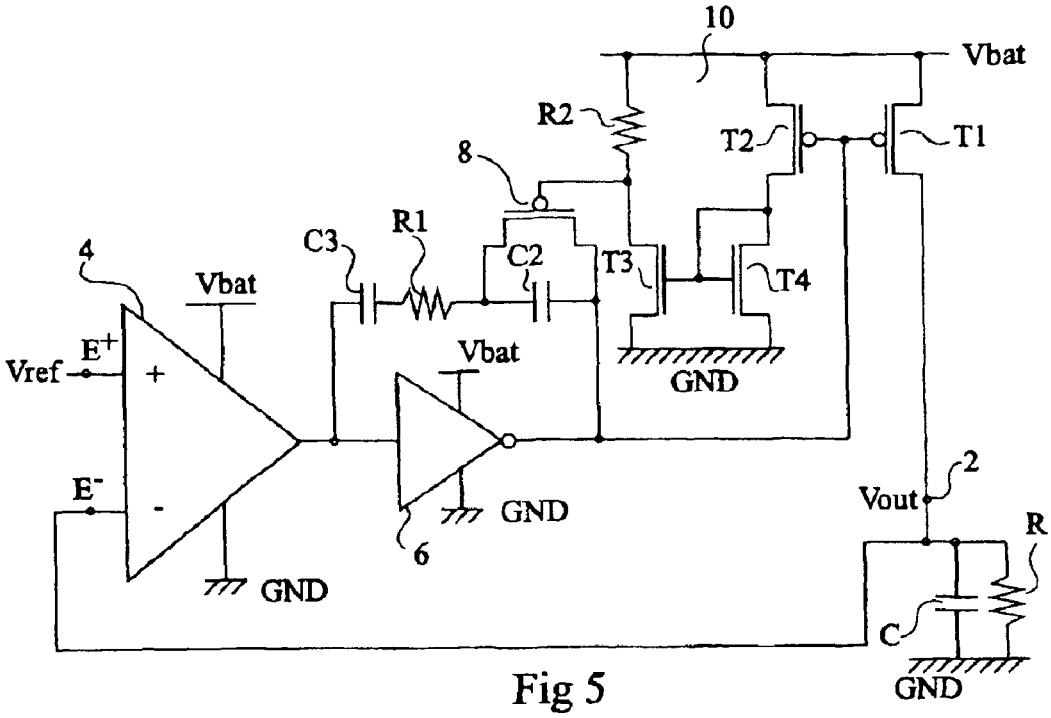
FIG. 5 schematically shows a first embodiment of the voltage regulator of FIG. 3.

FIG. 5 schematically shows a first embodiment of the voltage regulator of FIG. 3. Switch 8 is a P-channel MOS transistor having its drain and its source connected across capacitor C2. Control means 10 includes a control resistor R2 connected between voltage Vbat and the gate of transistor 8. Control means 10 further includes a P-channel MOS transistor T2, having its source connected to voltage Vbat. The gate of transistor T2 is connected to the gate of transistor T1, so that the current running through transistor T2 depends on the current running through transistor T1. Two N-channel MOS transistors T3, T4 have their sources connected to voltage GND and interconnected gates. The drain of transistor T4 is connected to the drain of transistor T2. The drain of transistor T3 is connected to the gate of transistor 8.

Transistors T3 and T4 form a current mirror which reproduces the current flowing through transistor T2. The current flowing through resistor R2 depends on the current running through transistor T1, that is, on the output current. When the current running through the load resistor increases, the current running through resistor R2 increases and the voltage drop across this resistor increases. The ratios of transistors T1 and T2, T3 and T4, and resistance R2 determine the predetermined current beyond which transistor 8 is activated. The switching of transistor 8 is not instantaneous. When transistor 8 is partially on, it can be considered that if parasitic components are neglected, transistor 8 behaves as a variable resistor, value Rvar of which substantially varies between 0 and infinity. The capacitance of the impedance arranged between the terminals of amplifier 6 continuously varies between C3 and C2 when Rvar respectively varies between 0 and infinity.

Figure 6:
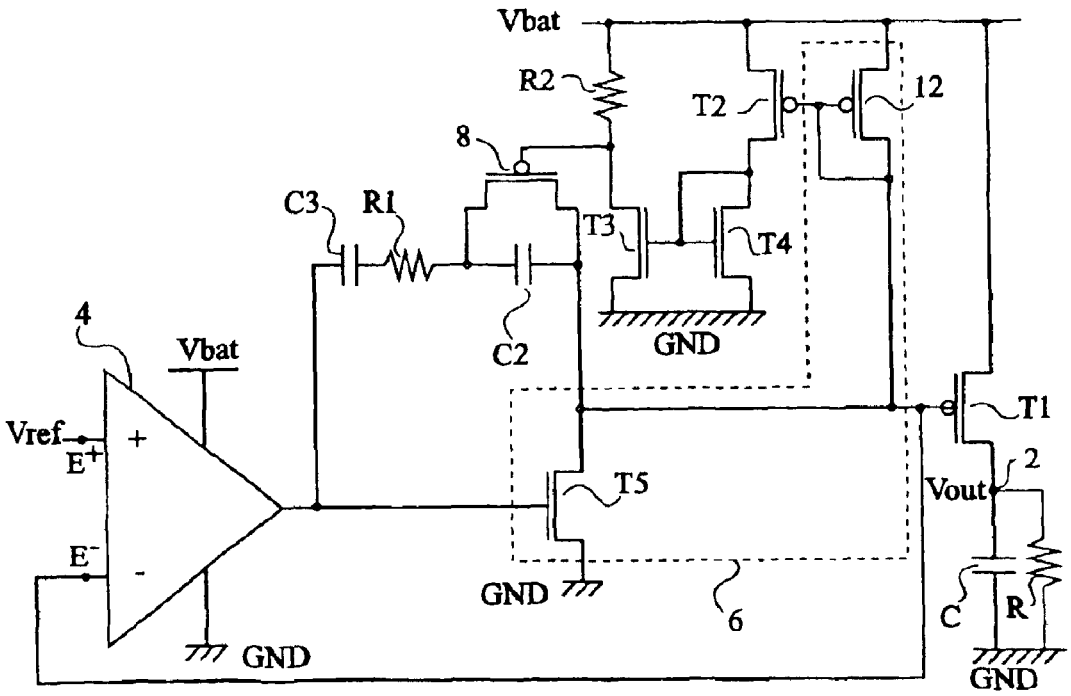
FIG. 6 schematically shows a second embodiment of the voltage regulator of FIG. 3.

FIG. 6 schematically shows a second embodiment of the voltage regulator of FIG. 3. Inverter amplifier 6 is formed of an N-channel MOS transistor T5, the drain of which is connected to a biasing means 12. The source of transistor T5 is connected to voltage GND, the gate of transistor T5 is connected to the input terminal of amplifier 6 and the drain of transistor T5 is connected to the output terminal of amplifier 6. Biasing means 12 is a P-channel MOS transistor having its drain and its gate connected to the drain of transistor T5 and having its source connected to voltage Vbat. As in FIG. 5, switch 8 is a P-channel MOS transistor. Control means 10 includes a resistor R2 connected between voltage Vbat and the gate of transistor 8 and a current mirror formed of two N-channel MOS transistors T3, T4 provided to control the current flowing through resistor R2. The drain of transistor T4 is connected to the drain of a P-channel MOS transistor T2 having its source connected to voltage Vbat. The gate of transistor T2 is connected to the gate of transistor T1.

The gate voltages of transistors 12 and T1 are identical and the current running through transistor 12 depends on the current running through transistor T1, that is, on the output current. The current running through transistor T5 is equal to the current running through transistor 12. The gain of MOS transistor T5 decreases when the current running therethrough increases. Thereby, when the output current increases, the gain of amplifier 6 decreases and the values of secondary poles P1, P2 respectively decrease and increase. Such an amplifier 6 enables improving the voltage regulator stability, which may for example enable use of a charge capacitor C of small size, of low bulk but which is not advantageous for the regulator stability. Transistor T2 forms a current mirror with transistor 12, so that the voltage drop across resistor R2 varies according to the output current in a way similar to the operation described in relation with FIG. 5.

For simplicity, the present invention has been described in relation with a resistive load R, the value of which decreases when the output current increases. In practice, the load may be a complex load. In this case, its resistive component decreases when the output current increases.

Of course, the present invention is likely to have various alterations, modifications, and improvements which will readily occur to those skilled in the art. As an example, the present invention has been described in relation with an open-loop operational amplifier, the open-loop transfer function of which includes a main pole, two secondary poles, and one zero, but those skilled in the art will easily adapt the present invention to an open-loop voltage regulator having a different open-loop transfer function, for example having a greater number of poles and zeros.

The present invention has been described in relation with a Miller stage, which includes the series connection of a fixed impedance, including a capacitor C3 and a resistor R1 connected in series, and of a short-circuitable impedance including a capacitor C2. However, those skilled in the art will easily adapt the present invention to a different Miller stage including another fixed impedance or another short-circuitable impedance. For example, the fixed impedance may include or not a series resistor. The short-circuitable impedance may include instead of a capacitor, a resistor, or a resistor and a capacitor connected in series. As seen previously, a resistor will have an action upon the position of zero Z1.

The present invention has been described in relation with a Miller stage having a capacitive impedance and a short-circuitable impedance with predetermined values, but those skilled in the art will easily adapt the present invention to other values.

The present invention has been described in relation with a positive supply voltage Vbat, but those skilled in the art will easily adapt the present invention to a negative supply voltage Vbat, by inverting the types of the described MOS transistors and the biasing of voltage Vref.

The present invention has been described in relation with a voltage regulator using a power switch T1, but those skilled in the art will easily adapt the present invention to a voltage regulator using another type of voltage control power switch.

The present invention has been described in relation with a regulator in which two capacitors C2 and C3 are arranged in series across amplifier 6, and in which capacitor C2 is short-circuited if the output current exceeds a first predetermined threshold. However, those skilled in the art will easily adapt the present invention to a regulator having a wide stability range, in which two or more capacitors of decreasing values C2, C2' and C3 are arranged in series across amplifier 6, and in which each capacitor C2, C2' is short-circuited if the output current exceeds a predetermined threshold specific to each capacitor C2, C2'.

For simplicity, the present invention has been described in relation with a voltage regulator using a non-resistive feedback loop and providing a voltage equal to a received reference voltage Vref. However, those skilled in the art will easily adapt the present invention to a voltage regulator in which the feedback loop includes a resistive bridge, and which outputs a voltage different from received voltage Vref.

What is claimed is:

1. A voltage regulator having an output terminal adapted to being connected to a load, the impedance of which decreases when the current flowing therethrough increases, comprising:

an operational amplifier having a non-inverting input connected to a reference voltage, and an inverting input connected to the output terminal;

an inverting amplifier having an input connected to an output of the operational amplifier;

a capacitive impedance connected between the input and an output of the inverting amplifier, including a short-circuitable portion associated with active short-circuit means when the current flowing through the load is greater than a predetermined current;

a power switch controlled by an output of the inverter amplifier, arranged to connect the output terminal to a first supply voltage; and a charge capacitor arranged between the output terminal and a supply voltage.

2. The voltage regulator of claim 1, wherein the capacitive impedance includes a first capacitor connected in series with a resistor and a second short-circuitable capacitor.

3. The voltage regulator of claim 2, wherein the capacitance of the second capacitor is smaller than the capacitance of the first capacitor.

4. The voltage regulator of claim 1, wherein the short-circuit means include:

a first P-channel MOS transistor having a drain and a source connected across the short-circuitable impedance portion, a control resistor arranged between the first supply voltage and a gate of the first transistor, a controllable current source arranged between the gate of the first transistor and the second supply voltage, and means for controlling the current source to provide the current source with a control signal depending on the current flowing through the load.

5. The voltage regulator of claim 4, wherein the current source includes second and third N-channel MOS transistors having sources connected to the second supply voltage and interconnected gates, a drain of the second transistor being connected to the gate of the first transistor, a drain and the gate of the third transistor being interconnected.

6. The voltage regulator of claim 5, wherein the means for controlling the current source includes a fourth P-channel MOS transistor, having a drain connected to the drain of the third transistor and a source connected to the first supply voltage, a gate of the fourth transistor being connected to the gate of the power switch.

7. The voltage regulator of claim 6, wherein the inverter amplifier includes a fifth N-channel MOS transistor having a source connected to the second supply voltage, and having a gate and a drain respectively connected to the input and to the output of the inverter amplifier, and a sixth diode-connected P-channel MOS transistor having a drain and a source respectively connected to the drain of the fifth transistor and to the first supply voltage.

8. A device, comprising:

an inverting amplifier having an input and an output;

an impedance circuit connected between the input and the output; and a variable capacitive element within the impedance circuit, including first and second capacitors, the second capacitor configured to be short-circuitable when a load current exceeds a preset value.

9. The device of claim 8, wherein the capacitive element is infinitely variable between first and second capacitive values, and wherein the value of the capacitive element varies in response to a change in a load current.

10. The device of claim 8, further comprising:

an operational amplifier having an output connected to the input of the inverting amplifier and a non-inverting input connected to a voltage reference; and a power switch having a control input connected to the output of the inverting amplifier, a first conduction terminal connected to a voltage source, and a second conduction terminal connected to an output terminal of the device, the variable capacitive element being configured to vary in response to a load current flowing through the power switch.

11. A method comprising:

applying a voltage to a load circuit;

regulating the voltage to the load circuit through the use of a regulator circuit including an amplifier having an input and an output, the amplifier having an impedance circuit connected between the input and the output; and modifying a capacitive value of a capacitive element in the impedance circuit in response to changes of a load current output by the regulator circuit, including short circuiting one of a plurality of capacitors in the impedance circuit.

12. The method of claim 11, wherein the modifying step is performed if the load current exceeds a preset value.

13. A method comprising:

applying a voltage to a load circuit;

regulating the voltage to the load circuit through the use of a regulator circuit including an amplifier having an input and an output, the amplifier having an impedance circuit connected between the input and the output; and modifying a capacitive value of a capacitive element in the impedance circuit in response to changes of a load current output by the regulator circuit, including partially short circuiting one of a plurality of capacitors in the impedance circuit.

14. A device, comprising:

an inverting amplifier having an input and an output;

an impedance circuit connected between the input and the output; and a variable capacitive element within the impedance circuit;

and wherein the impedance circuit includes a sub-circuit configured to vary the capacitance of the variable capacitive element when a load current of the device changes beyond a selected threshold.

15. A device, comprising:

an inverting amplifier having an input and an output;

an impedance circuit connected between the input and the output;

a variable capacitive element within the impedance circuit; and means for measuring a load current of the device and varying the capacitance of the variable capacitive element in response to variations in the load current.

16. A device, comprising:

an inverting amplifier having an input and an output;

an impedance circuit connected between the input and the output; and a variable capacitive element within the impedance circuit, including a plurality of capacitors and a switch element configured to engage and disengage at least one of the plurality of capacitors from the impedance circuit.

17. A voltage regulator, comprising:

an output, configured to provide a regulated voltage to a load;

an amplifier circuit having an input and an output;

an impedance connected between the input and the output, the impedance including a resistive element and a variable capacitive element, a capacitance of the capacitive element being configured to vary in response to variations in a load current of the voltage regulator; and a detection circuit configured to detect a level of the load current and to vary the capacitance of the capacitive element in response to variations in the level of the load current.

18. The voltage regulator of claim 17 wherein the detection circuit includes a switch configured to electrically remove a portion of the capacitive element from the impedance circuit.

* * * * *